United States Patent [19]

Pittman et al.

[11] Patent Number: 4,716,645

[45] Date of Patent: Jan. 5, 1988

[54] METHOD OF MAKING BUILDING PANELS AND THE LIKE

[75] Inventors: Raymond H. Pittman, Batavia; William J. Schultz, St. Charles, both of Ill.

[73] Assignee: Masonite Corporation, Chicago, Ill.

[21] Appl. No.: 877,190

[22] Filed: Jun. 23, 1986

Related U.S. Application Data

[62] Division of Ser. No. 629,625, Jul. 11, 1984, Pat. No. 4,617,774.

[51] Int. Cl.[4] ..... B26F 1/00; B26F 3/00

[52] U.S. Cl. ..... 29/527.1; 29/414; 51/324; 83/17; 83/920

[58] Field of Search ..... 29/163.5 R, 414, 527.1; 83/14, 17, 18, 920; 51/324

[56] References Cited

U.S. PATENT DOCUMENTS

| | | | |
|---|---|---|---|
| Re. 24,246 | 12/1956 | Fink et al. | 108/8 |
| 373,373 | 11/1887 | Montross . | |
| 835,189 | 11/1906 | Karfiol | 51/324 |
| 2,264,546 | 12/1941 | Ochs | 20/5 |
| 3,333,384 | 8/1967 | Brady | 52/557 |
| 3,626,439 | 12/1971 | Kneisel | 52/533 |
| 3,643,394 | 2/1972 | Johnson | 52/309 |
| 3,702,031 | 3/1973 | Wilson et al. | 52/520 |
| 3,703,795 | 11/1972 | Mattes | 52/521 |
| 3,796,586 | 9/1971 | Hanlon et al. | 117/8 |
| 3,848,383 | 11/1974 | Wilson et al. | 52/533 |
| 3,848,384 | 11/1974 | Eaton et al. | 52/420 |
| 3,852,934 | 12/1974 | Kirkhuff | 52/539 |
| 3,868,300 | 2/1975 | Wheeler | 162/124 |
| 3,897,667 | 8/1975 | Turek | 52/546 |
| 3,899,855 | 8/1975 | Gadsby | 52/90 |
| 3,927,501 | 12/1975 | Allen et al. | 52/555 |
| 3,943,677 | 3/1976 | Carothers | 52/309 |
| 4,061,813 | 12/1977 | Geimer et al. | 428/183 |
| 4,065,899 | 1/1978 | Kirkhuff | 52/309.8 |
| 4,102,106 | 7/1978 | Golder et al. | 52/533 |
| 4,188,762 | 2/1980 | Tellman | 52/541 |
| 4,261,152 | 4/1981 | Tellman | 52/541 |
| 4,266,382 | 5/1981 | Tellman | 52/316 |
| 4,279,106 | 7/1981 | Gleason et al. | 52/100 |
| 4,366,197 | 12/1982 | Hanlon et al. | 428/43 |

FOREIGN PATENT DOCUMENTS

| | | | |
|---|---|---|---|
| 2016045 | 10/1971 | Fed. Rep. of Germany | 83/17 |
| 0000016 | of 1874 | United Kingdom | 51/324 |

*Primary Examiner*—Howard N. Goldberg
*Assistant Examiner*—Taylor J. Ross
*Attorney, Agent, or Firm*—Mason, Kolehmainen, Rathburn & Wyss

[57] ABSTRACT

A new and improved method of making an opening extending between opposite faces of thin sheet material comprises the steps of forming a depression in one of the faces of the sheet material resulting in a projection opposite the depression on the opposite face protruding outwardly thereof and removing the projection to form an opening extending completely through the sheet material between said opposite faces.

14 Claims, 3 Drawing Figures

FIG. 2
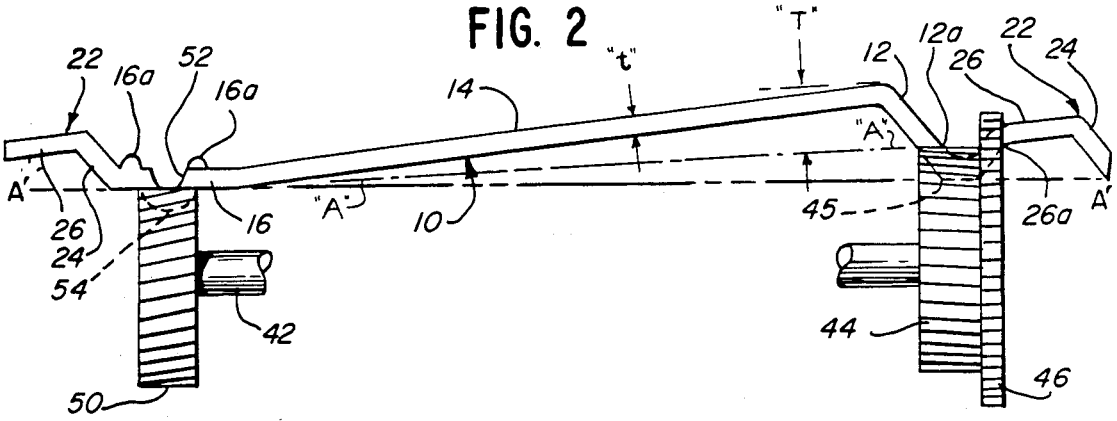
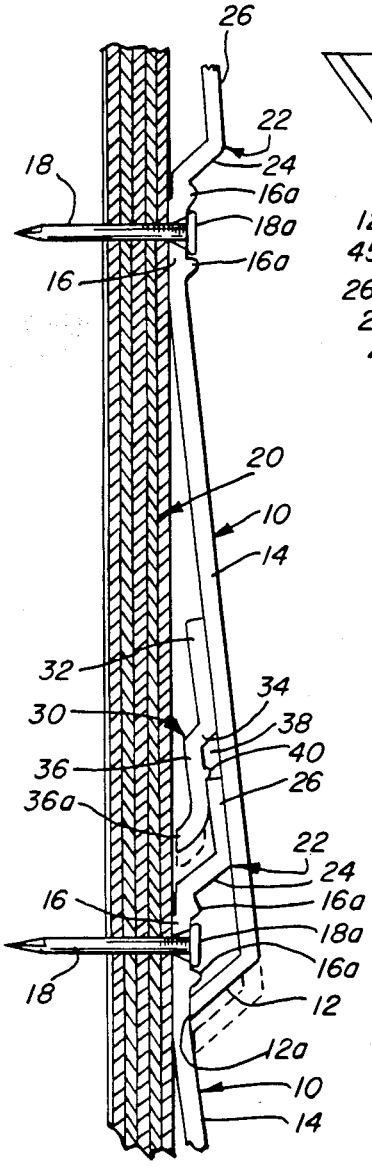
FIG. 3
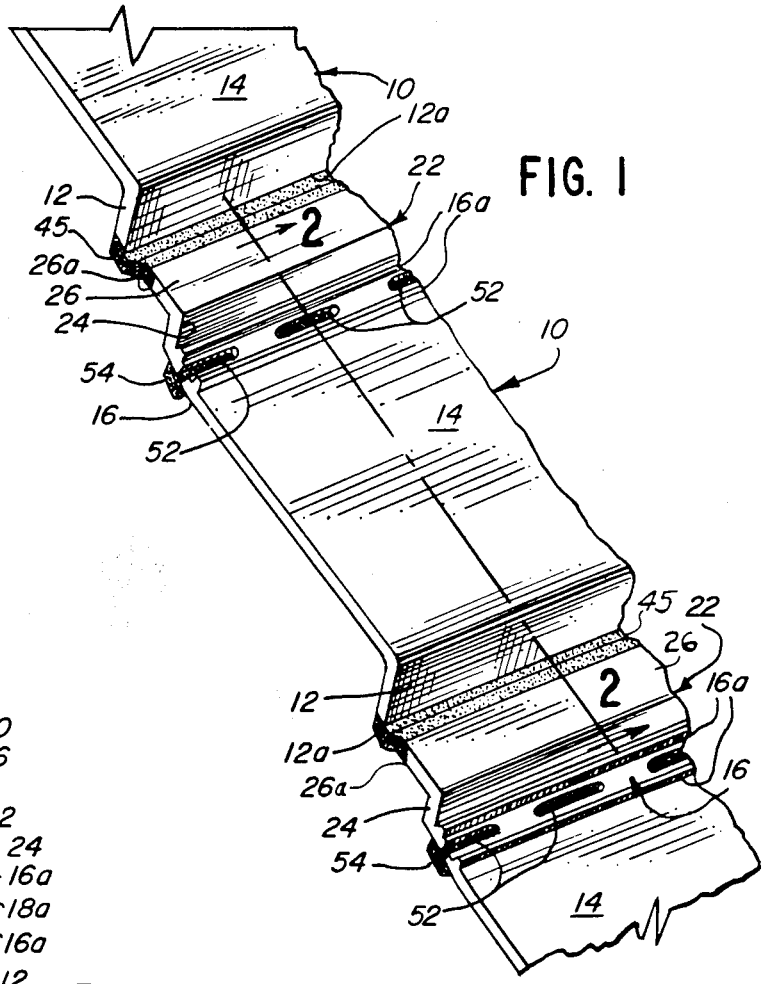
FIG. 1

METHOD OF MAKING BUILDING PANELS AND THE LIKE

This application is a division of application Ser. No. 629,625, filed July 11, 1984, now U.S. Pat. No. 4,617,774.

BACKGROUND OF THE INVENTION

1. Field of the Invention

The present invention relates to a method of making an opening in thin sheet material such as building panels for exterior and interior wall and roof surfaces of a building structure and more particularly, a new and improved method of making fastener receiving slots in a building panel formed of relatively thin walled, molded hardboard having an outer weather face designed to resemble historrical or traditional siding material such as lap siding, drop siding, shingles and shakes, etc.

2. Brief Description of the Prior Art

Over the years, a wide variety of siding and roof profiles have been developed both in wood, asphalt or mineral based materials as well as aluminum and vinyl. In general, man-made materials have sought to replicate or copy the external appearance of historical or traditional wood products. The following U.S. patents have been issued relating to building wall and roof siding, paneling and shingle products:

| | | | |
|---|---|---|---|
| Fink et al | RE. 24,246 | Turek | 3,897,667 |
| Montross | 373,373 | Gadsby | 3,899,855 |
| Ochs | 2,264,546 | Carothers | 3,943,677 |
| Brady | 3,333,384 | Allen et al | 4,366,197 |
| Kneisel | 3,326,493 | Eaton | 4,015,392 |
| Johnson | 3,643,394 | Geimer et al | 4,061,813 |
| Mattes | 3,703,795 | Kirkhuff | 4,065,899 |
| Wilson et al | 3,720,031 | Golder et al | 4,102,106 |
| Hanlon et al | 3,796,586 | Tellman | 4,188,762 |
| Wilson et al | 3,848,383 | Tellman | 4,261,152 |
| Eaton et al | 3,848,384 | Tellman | 4,266,382 |
| Kirkhuff | 3,852,934 | Gleason et al | 4,279,106 |
| Wheeler | 3,868,300 | Hanlon et al | 4,366,197 |

OBJECTS OF THE INVENTION

It is an object of the present invention to provide a new and improved method of making an opening in thin sheet material such as building panels and the like.

An object of the present invention is to provide a new and improved method for making a building panel for exterior and interior wall and roof surface of building structures, more particularly, for making a panel having an elongated body formed of relatively thin, molded hardboard.

It is an object of the present invention to provide a method for making a building panel of the character described which may be molded into intricate profiles or shapes to closely resemble historical and traditional profiles of wood products used for siding and roofing on houses and the like.

Yet another object of the present invention is to provide a method for making new and improved building panel of the character described which is especially designed to provide a much greater surface area coverage but with a much lower weight of material being required per unit area covered.

Still another object of the present invention is to provide and new and improved building panel of the character described which has a new and unique system and method for providing nail or fastener slots therein adapted to receive nails or other fastener shanks used for securing the panels in place on a wall or roof structure.

Still another object of the present invention is to provide a method for making a new and improved building panel of the character described adapted to be laid up or applied in overlapping courses or rows and provided with means permitting individual panels to expand and contract without encountering serious problems such as buckling, cracking, splitting or weather leakage.

Yet another object of the present invention is to provide a method for making a new and improved building panel of the character described which may be economically produced and which is easily handled and capable of rapid and easy installation, even by unskilled artisans on a wide variety of different types of building wall and roof structures.

Yet another object of the present invention is to provide a method for making new and improved building panel or lap siding product formed of molded, thin-walled, hardboard material which is self-aligning during installation and which panel facilitates the installation thereof by providing elongated fastener receiving slots therein intermediate the upper and lower edges of the panel.

Yet another object of the present invention is to provide a method for making new and improved building panel of the character described which has greatly improved resistance against wind uplift forces and which provides an excellent outer weather seal and surfacing for a building wall or roof structure, yet still permits individual panels to expand and contract in response to the level of moisture contained therein and the temperature changes encountered.

Another object of the invention is to provide a method for making new and improved building panel of the character described having an elongated fastener receiving strip adjacent an upper edge including a plurality of longitudinally spaced apart, fastener receiving depressions which are integrally formed therein initially in the molding process and then are completed by machining a back face of the panels so as to open up nailing slots which extend completely through the panel body between inner and outer faces of the panel.

Yet another object of the present invention is to provide a new and improved method of making an elongated fastener receiving strip portion in a thin-walled, molded hardboard building panel which provides a plurality of open slots at longitudinally spaced intervals therein a row for receiving fasteners used for application of the panels onto a building wall or roof structure.

SUMMARY OF THE INVENTION

The present invention comprises a new and improved method of making an opening such as a nail slot in thin sheet material such as a building panel and the like, and includes the steps of forming a depression in one face of the sheet material resulting in a projection opposite said depression on the opposite face protruding outwardly of the sheet face. The projection is then removed by machining and the like thereby forming an opening in the thin sheet material extending completely therethrough between the opposite faces.

The foregoing and other objects and advantages of the present invenntion are accomplished in an embodiment comprising a new and improved building panel for exterior and interior wall and roof surfaces having an elongated body formed of relatively thin, molded hardboard material having upper and lower edges, opposite ends, an outer weather face molded and embossed to resemble historical and traditional siding and/or roofing profiles and a contoured back face generally following the variations in the outer weather face thereof. The body of the panel includes a lower edge portion extending upwardly and outwardly of the lower edge of the panel which joins an intermediate fascia portion which is spaced outwardly of the lower edge. An elongated fastener receiving strip is formed along an upper edge of the intermediate fascia portion of the panel and the fastener strip includes a plurality of longitudinally spaced apart, fastener receiving, integrally molded depressions. After molding, the strip is machined along a back face of the panel to a depth intersecting the depressions which protrude from the back face of the panel. The machining operation removes the protrusions to cut open and define a plurality of open slots, which slots extend completely through the panel to form elongated nail holes or slots for receiving the shanks of nails or other fasteners used for securing the building panels to a wall or roof structure. Above the fastener receiving strip, the panel is provided with an upper edge portion which includes an upwardly and outwardly extending first segment adapted to underlie a lower edge portion of a panel(s) laid up in a next higher course, and an upper second segment which forms the upper edge of the panel.

BRIEF DESCRIPTION OF THE DRAWING

For a better understanding of the present invention, reference should be had to the following detailed description taken in conjunction with the drawing in which:

FIG. 1 is a fragmentary front elevational view of a new and improved panel constructed in accordance with the features of the present invention and shown after a panel has been molded in a large blank containing several panels but has not yet been separated into individual panels therefrom;

FIG. 2 is a transverse cross sectional view of a panel in accordance with the present invention and illustrated in graphic form, a machining operation used for trimming the edges of the panel blank and for forming elongated nail or fastener slots in a fastener receiving strip portion thereof by machining off protrusions on the panel back face to form a row of open holes, and;

FIG. 3 is a fragmentary, vertical cross-sectional view of a building wall structure showing panels in accordance with the present invention after installation thereof.

DESCRIPTION OF THE PREFERRED EMBODIMENT

Referring now more particularly to the drawings, building panels 10 in accordance with the invention are formed of a thin-wall, molded hardboard material in a press, generally of the type shown in U.S. Pat. No. 1,923,548. Panel blanks of the desired profile are molded between pairs of upper and lower press plates, which plates are shaped and designed to form the relatively intricate profile and surface as illustrated in FIG. 1. The press plates may be as large as 4′×16′ and in accordance with the present invention, panel blanks of a molded configuration as shown in FIG. 1 may contain four or more panels 10 which are nominally 12″ wide by 16′ long. Each panel has an intrically molded transverse profile designed to replicate and simulate historical or traditional profiles of wood lap siding or drop siding.

Each panel 10 is formed with a lower edge portion 12 sloping upwardly and outwardly from a lower edge **12*a* at an obtuse angle from a back plane "A—A" of the panel defined to extend between said lower edge and a back surface portion of the panel spaced upwardly of the back plane as represented by the line "A—A" in FIG. 2. The panel wall has an approximate thickness "t" of ⅛th″ but the panel 10 as a whole has an overall maximum depth or thickness "T" (FIG. 2**) between the back plane and an outer face thereof which is considerably larger (½″ to ¾″) than the relatively thin wall thickness "t" of the molded hardboard material.

At the upper and outer edge, the lower edge portion 12 integrally joins the lower edge of a relatively flat, intermediate fascia portion 14 at an obtuse angle and the fascia portion may contain at least one or a plurality of lap siding elements, integrally joined by one or more butt edge portions parallel of the lower edge portion 12. While a single lap configuration is illustrated, the panels 10 may be of a multi-lap configuration having several narrower laps if desired. At the upper edge, the fascia portion integrally joins a narrow, fastener receiving strip 16 having a pair of outwardly projecting, longitudinally extending, parallel guide ribs **16*a* along the upper and lower edges thereof. The guide ribs 16*a* are adapted to accommodate the heads 18*a* of a nail 18 or other type of fasteners used for securing the strip 16 of the panels 10 to a building wall or roof structure 20** as the panels are applied on a building.

Along the upper edge, each panel is provided with an upper edge portion 22 having a lower segment 24 integrally joining the fastener strip 16 and projecting upwardly and outwardly thereof at an obtuse angle. The upper edge portion also includes a upper edge segment 26 joining the lower segment 24 and lying in a plane generally parallel to the intermediate fascia portion 14 of the panel.

As best illustrated in FIG. 3, the upper edge portion 22 is adapted to underlie a lower portion of the fascia 14 of a panel or panels in a next higher course or row, and the upper segment 26 is adapted to slidably engage and/or face the back side of the fascia portion 14 of a next higher panel(s).

In accordance with the present invention, each panel 10 is provided with a fastening or interlocking joint strip 30 formed of molded hardboard material and having an upper edge portion 32 secured to the back side of the panel fascia 14 with adhesive or other appropriate securing means. The joining strip 30 is mounted near a lower edge of the fascia portion and includes an angularly offset portion 34 and a lower portion 36 having a curved lower end portions **36*a* flared outwardly away from the back side of the adjacent fascia portion 14. The curved lower end portion of the strip provides guidance for interlocking the strip 30 with the upper edge segment 26 along the upper edge portion of a lower panel when successive panels are laid up or positioned on a building wall or roof surface. The lower segment 36 of the joining strip is spaced apart from the back surface of the panel fascia 14 to define an open area or slot 38 (FIG. 3) for slidably receiving the tongue-like, upper edge segment 36** of a panel in the prior course as successive panels are installed.

In order to properly space and self-align the panels upon each other in slidable but interlocking relation between successive courses, the lower portion 36 of the joining strip 30 is formed with a small, outwardly extending, integral spacer rib 40 which butts or engages the upper edge of the upper segment 26 in the next lower panel to provide automatic self alignment during installation. The rib 40 has a relatively small, transverse cross section so that should the panel dimensions change substantially after initial installation, the sharp upper edge surface of the segment 26 of a lower panel may shear off or severe the ridge 40 from the remaining portion of the joining strip 30 and thereafter the interlocking panel edge and joining strip can move relative to one another without substantial interference or buckling forces being generated.

Expansion and contraction of panels is caused because of subsequent absorption and desorption of moisture and other weather factors. Thus, the rib 40 serves as a spacer during initial installation and thereafter may be fractured or severed away so as not to interfere with free relative sliding movement between the interlocking upper edge segment 26 on a lower panel and the lower edge 36 of the joining strip 30 of an interlocking higher panel. The interlocking relationship thus formed between panels laid up in succession is a floating type joint or interconnection which accommodates relative expansion and contraction of both the upper and lower interlocked panel portions. Such expansion and contraction is often encountered because of moisture absorption and desorption, and the slip-joint interconnection permits free movement of the panel segments without cracking or buckling, and permits such movement while still retaining a positive interlocking relation. Thus buckling, bending or other damage to the relatively thin-walled, panel members is avoided.

As illustrated in FIG. 3 in dotted lines, the lower end portion of a panel including a joining strip 30 on the inside surface or back face of the fascia portion 14 may tend to expand and move downwardly relative to a next lower panel by an amount somewhat dependent on the moisture absorbed since originally installed. This expansion can result in a shearing off of the small rib 40 which has a relatively small cross-section. After shearing of the rib 40 has occurred, further downward relative movement between the lower facia portions of the upper panels and the relatively fixed, upper edge portions of the lower panels is readily accommodated without resulting in built-up stresses between the interlocked rows or courses of panel members on a wall or roof. In addition, the positive interlocking relationship between the joining strips 30 on upper panels and the upper edge segments 26 on adjacent lower panels is continuously maintained to provide a secure and positive interlock between successive panel courses at all times after initial installation is completed.

The panels 10 are applied or installed on a building wall or roof with spaced apart fasteners such as nails 18 or other fasteners that are driven into the fastener strip 16 of each panel through elongated nail slots 52 provided at approprimate intervals between the ribs **16*a***. The nail receiving strip is located adjacent an upper edge portion of the panel and this portion is subsequently interlocked to the next upper panel applied on the building wall.

In accordance with the present invention, a panel blank containing a plurality of panels 10 (usually 4, 6 or 8) like that shown in cross-section in FIG. 1 is machined or cut to the separate individual panels from adjacent panels in the blank. This separation is accomplished as illustrated in FIG. 2 with a rotary saw or cutter mechanism like a table saw and the cutters are mounted on an arbor shaft 42 which is rotationally driven by a suitable power unit. The saw may have a planar work surface or a plurality of rolls which act a table or horizontal supporting surface as illustrated by the dashed line "A'—A'". A lower edge portion or surface **12*a* of a panel edge is cut away and edge trimmed by movement of a panel blank in a single longitudinal pass over a first saw or cutter 44. This cutter removes a strip of material labelled 45 from the back or underside of the multi-panel molded blank. The cutter 44 provides a neatly cut, sharply trimmed edge 12*a* at the lower edge portion 12 of one panel and a similar sharp and neatly trimmed upper edge segment 26*a* at the upper edge portion 22 of the adjacent panel in the blank while severing the blank into two separate pieces at one time on a single pass. An upper edge 26*a* of the panels is cut or trimmed by a second saw or cutter 46 having a slightly greater diameter and this cutter produces true and straight trimmed edges 12*a* and 26*a* as the individual panels 10** are separated from a larger blank containing several such panels.

In accordance with an important feature of the present invention, yet another saw or back cutter 50 is mounted on the same arbor shaft 42 in order to trim and face the back surface of the fastener strip portion 16 of the panels 10. The back face trimming cut simultaneously produces a plurality of elongated, longitudinally spaced apart, fastener receiving holes or slots 52 in the fastener strip section 16 of the panels between the spaced apart, parallel ridges **16*a***.

The molds or press plates that are used in forming the large panel blanks (containing several molded panels 10) are provided with appropriately shaped positive mold projections on the upper mold plate which forms the outer panel faces and these projections are generally matched or mated to cooperate with somewhat larger sized, similarly shaped recesses provided on the lower or bottom plate. When the upper and lower plates are closed during a pressing operation, a plurality of protruding mounds or bosses 54 of molded hardboard are formed in the panel blank at longitudinal intervals in a row on the back face of each panel strip portion 16. The cooperating press plate surfaces provide a continuous shell of molded material between the upper or inside surfaces of the elongated openings 52 and the back face of the panel blank. These protruding bosses or projections 54 are subsequently removed and machined away or trimmed off from the back side of the panel blanks by the cutter or saw 50 as the panel blanks move in a single pass over the arbor shaft. The cutter action in removing the rearwardly protruding mounds of material 54 results in the formation of clean cut elongated, slotted nail opening 52 at appropriate longitudinal intervals along the panel strip portion 16. At the same time, the back face of the strip portion 16 is smoothly surfaced or planed away ready to abutt a building wall surface when the panels are installed (FIG. 3).

The nail slots 52 are located at appropriately spaced intervals along the fastener strip portion 16 of each panel and are adapted to guide the reception and installation of fasteners such as nails, staples, screws etc. or other types of suitable fasteners, which may be applied with a hammer or with an automatic fastener driving tool or gun. In the latter case, the ribs 16a in cooperation with the elongated slots 52 provide guidance for a workman in positioning the nose or drive track of a tool in the desired position along the center of the fastener strip 16 of a panel for securing the panel in place on a building wall or roof structure.

The novel method of forming the nail slots 52 which comprise apertures extending completely through the panel thickness is achieved by first providing recesses in the front side of the panels resulting in molded projections 54 on the backside. Subsequently these projections are machined away and removed from the back face resulting in the formation of the nail slots. The panels are trimmed and surfaced in a single longitudinal pass of a panel blank over the arbor shaft and a sequential operation of punching, slotting or drilling with repetitive, punch press type operations heretofore used when forming fastener receiving slots is eliminated. This new and unique process greatly contributes to the overall economy of manufacture of the molded panels 10 in accordance with the present invention.

Although the present invention has been described with reference to an illustrated embodiment thereof, it should be understood that numerous other modifications and embodiments can be made by those skilled in the art that will fall within the spirit and scope of the principles of this invention.

What is claimed as new and desired to be secured by Letters Patent is:

1. A method of forming a nail slot in a molded hardboard building panel having an outer face and a back face, comprising the steps of:

molding a depression in said outer face during the initial consolidation of a relatively thick mat of wood fibres into a relatively thin sheet of molded hardboard material forming said panel and resulting in a mold-formed projection opposite said depression protruding outwardly on said back face;

curing said molded hardboard material into relatively rigid form after said initial formation; and removing said projection from said back face to form an opening between said faces comprising said nail slot.

2. The method of claim 1 wherein a plurality of said nail slots are provided, aligned in a row, comprising the steps of:

forming a plurality of said depressions and opposite projections along a row during the molding of said panel; and removing said projections to provide a plurality of open nail slots along said row by relative movement between said panel and a cutting means in a direction along said row.

3. The method of claim 2 wherein said back face of said panel is surfaced by said cutting means to form a planar strip while said projections are being removed.

4. The method of claim 2 wherein said panel comprises one of several panels in a common molded blank, including the steps of:

separating said one panel from said blank while said projections are being removed.

5. The method of claim 4 wherein upper and lower edges of said one panel are trimmed while said one panel is being separated from said blank.

6. A method of making an opening extending between opposite faces of thin sheet material, comprising the steps of:

initially mold-forming a relatively thick mat of wood fibrous material into a relatively thin, hardboard panel providing at least one depression in one of said faces having a depth greater than the nominal thickness of said sheet material between said opposite faces, said molded depression resulting in a projection being formed on said other face opposite said depression and protruding outwardly from said other face;

solidifying said molded hardboard panel and said projection into a rigid form; and mechanically removing said rigid form projection from said other face to form said opening extending completely through said sheet material between said opposite faces thereof.

7. The method of claim 6 wherein said sheet material comprises a substantial proportion of composite wood fibrous material consolidated under heat and pressure.

8. The method of claim 6 wherein said projection is removed by a machining operation.

9. The method of claim 8 wherein said machining operation is effective to provide a planar surface on said other face around the perimeter of said opening.

10. The method of claim 6 wherein said depression includes opposite wall surfaces sloping toward one another and toward said other face.

11. The method of claim 6 wherein a plurality of said depressions are formed a spaced apart locations on said one face, and wherein said projections are subsequently removed by machining in single pass running between adjacent ones of said projections.

12. A method of making a wood fibre object having one or more slots therein comprising the steps of:

initially mold forming by heat and pressure a first surface of said object from a mat of unconsolidated wood fibres to provide one or more depressions therein extending toward a second opposite surface being simultaneously mold formed on said object resulting in a projection on said second surface opposite each depression and extending outwardly of a surrounding portion of said second surface;

solidifying said wood fibres into a consolidated sheet whereby said projection(s) becomes rigid in shape; and mechanically removing said rigid projection(s) so formed resulting in the formation of one or more slots extending completely through said object between said first and second surfaces.

13. The method of claim 12 wherein:

a plurality of said depressions are formed at spaced locations in a row on said first surface; and said projections opposite said depressions are removed by machining in a single pass along said row on said second surface.

14. The method of claim 12, wherein:

said depressions have opposite facing wall portions sloping inwardly toward one another between said first and second surfaces.

* * * * *